United States Patent [19]

Luke

[11] Patent Number: 4,637,410

[45] Date of Patent: Jan. 20, 1987

[54] CIGARETTES

[75] Inventor: John A. Luke, Eastleigh, England

[73] Assignee: Brown & Williamson Tobacco Corporation, Louisville, Ky.

[21] Appl. No.: 757,406

[22] Filed: Jul. 22, 1985

[30] Foreign Application Priority Data

May 24, 1985 [GB] United Kingdom ..... 8513233

[51] Int. Cl.[4] ..... A24D 1/00

[52] U.S. Cl. ..... 131/361; 131/360

[58] Field of Search ..... 131/361, 360, 84.1, 131/84.2, 84.3, 84.4, 906

[56] References Cited

U.S. PATENT DOCUMENTS 4,553,556 11/1985 Lephardt ..... 131/361

*Primary Examiner*—V. Millin

*Assistant Examiner*—H. Macey

*Attorney, Agent, or Firm*—Charles G. Lamb

[57] ABSTRACT

A cigarette comprises a tobacco rod of tobacco filler wrapped in a paper wrapper, the circumference of the rod being within a range of 10 mm to 19 mm and the free burn rate of the rod being within a range of 25 to 45 mg $min^{-1}$. The cigarette may comprise considerably less tobacco than a cigarette of orthodox circumference yet yield an equal or greater number of puffs.

5 Claims, 1 Drawing Figure

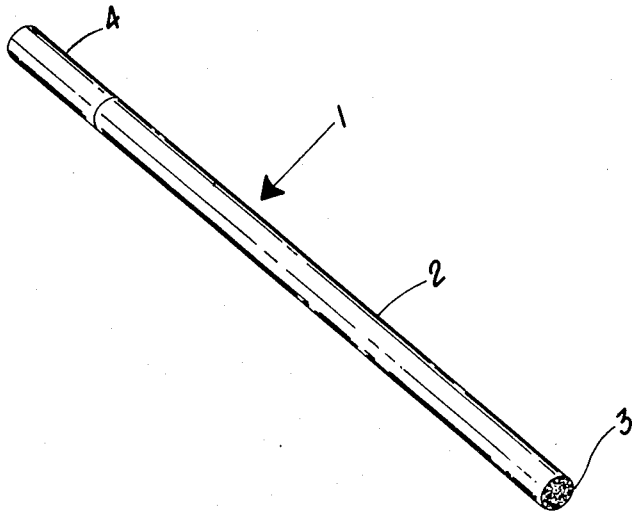
4
1
2
3

CIGARETTES

This invention relates to cigarettes.

It is a requisite of cigarettes of commercially acceptable quality that when lit but not being smoked, the coal continues to burn, at a slow rate, a condition usually referred to as smouldering. A number of cigarette design parameters affect the smoulder rate, otherwise known as the free or static burn rate. One of these is the air permeability of the cigarette paper; the lower the air permeability, the lower is the smoulder rate. Another factor relating to smoulder rate is the amount of tobacco which is consumed in unit time. It has previously been thought that for an acceptable linear smoulder rate, a minimum amount of about 60 mg of tobacco had to be consumed per minute in order to assure the maintenance in the coal of enough heat to sustain the coal in its smouldering condition. This factor has heretofore been seen to make it necessary for a cigarette rod of the usual circular cross section to have a circumference of at least about 22 mm if the cigarette was to smoulder in a reliable manner.

The present invention provides a cigarette comprising a tobacco rod which rod comprises a tobacco filler and a paper wrapper, the circumference of said rod being within a range of 10 mm to 19 mm, preferably 12.5 mm to 19 mm, and the free burn rate of said rod being within a range of 25 to 45 mg $min^{-1}$, and preferably being within a range of 30 to 45 mg $min^{-1}$.

The present invention is based on our finding that in point of fact cigarettes having circumferences of 19 mm or less and free burn rates of 45 mg $min^{-1}$ or less smoulder in a fully acceptable manner and that in addition such cigarettes exhibit a number of significant practical advantages.

There is no necessity in order to provide cigarettes according to the present invention which smoulder reliably between puffs to make compensatory adjustments to the cigarette paper air permeability value or to provide the cigarette paper with unorthodox levels of burn rate promoting additives, or in fact to make compensatory adjustments in regard to any other parameters which affect smoulder rate.

The packing density of the rod may be within a range of 150 mg $cm^3$ to 350 mg $cm^3$, and preferably within a range of 200 mg $cm^3$ to 300 mg $cm^3$.

Cigarettes according to the present invention, as well as being of elegant appearance, utilise tobacco with increased efficiency. Thus a cigarette may be provided according to the present invention which, compared with a cigarette of orthodox dimensions, having, for example, a circumference of 25 mm, comprises considerably less tobacco, 25% less for example, and yet which provides an equal, or even greater number of puffs. The actual number of puffs, will, of course, be dependent inter alia upon the length of the cigarette.

For unit length of tobacco rod, the reduction in the cigarette paper requirement is, leaving the longitudinal lap seam out of account, directly proportional to rod diameter reduction, whereas the reduction in tobacco requirements is, assuming constant packing density, in proportion to the ratio of the squares of the diameters. Thus in unit length of a cigarette according to the present invention the ratio of mass of cigarette paper to mass of tobacco is higher than that for a cigarette of conventional circumference at equal packing densities. Thus in cigarettes according to the present invention, exceptionally firm ash formations are obtainable.

In that cigarettes may be provided according to the present invention which contains less tobacco than orthodox cigarettes at equal puff numbers, cigarettes according to the present invention exhibit lower smoke component mainstream and sidestream deliveries.

It has been observed in comparing cigarettes according to the present invention with orthodox cigarettes of the same tobacco filler density and with the filler cut at the same number of cuts per inch, that the cigarettes according to the present invention are of firmer feel than the orthodox cigarettes. In other words, the same filler in the inventive cigarettes apparently has a higher filling power than when it is incorporated in orthodox cigarettes. It is surmised that this phenomenon may derive from the increase in the ratio of the mean particle size of the filler to the cross-sectional area of the tobacco rod. It does means though that for equal filling power values, a reduction in tobacco weight may be made over and above that resulting directly from the reduction in tobacco rod cross-sectional area.

The tobacco filler may comprise expanded tobacco, reconstituted tobacco or substitute smoking materials. The tobacco rods of cigarettes according to the present invention may be of a cross-section other than round. They may, for example, be of elliptical or rectilinear cross-section.

If cigarettes according to the present invention are fitted with filters and the filters are of the same transverse dimensions as the tobacco rods, there will be a saving in filter material requirements compared with those of orthodox filter tipped cigarettes. It may be observed in relation to the conventional form of filter comprising cellulose acetate, that a reduction in cellulose acetate tow utilisation can be effected without there necessarily being a change in pressure drop in going from orthodox filter circumferences to circumferences appropriate for filters for attachment to cigarettes according to the present invention.

For constant pressure drops and for unit length of filter the tow requirement is, in fact, reduced by an amount in excess of that suggested by the ratio of the areas of conventional and inventive cigarette.

By use of the present invention significant reductions in packaging material requirements per unit cigarette may be realised.

A cigarette in accordance with the present invention is shown in the accompanying diagrammatic drawing and is generally designated by reference numeral 1.

The cigarette 1 comprises cigarette paper 2 wrapped about a cut tobacco filler, to provide a tobacco rod, an end portion of which filler is referenced 3. Cigarette 1 further comprises a tipping wrapper 4 which serves to maintain a filter, of cellulose acetate tow for example, in abutment with the end of the tobacco filler remote end 3 thereof. The overall length of cigarette 1 is 120 mm and the diameter is 5 mm.

Cigarettes in accordance with the invention were made having tobacco rod lengths of 100 mm to which were attached 20 mm long filters. These cigarettes were made in two circumferences, 15 mm and 17 mm, the cigarettes being designated A and B respectively. Under standard smoking conditions, measurements were made of the total deliveries of mainstream smoke particulate matter, on a water and nicotine free basis, and of total nicotine alkaloids. By way of comparison, similar measurements were made for an orthodox commercially marketed cigarette of 25 mm circumference and having tobacco rod and filter lengths of 64 mm and 20 mm respectively. The results are as shown in the table below.

| | A | B | ORTHODOX |
|---|---|---|---|
| PMWNF (mg) | 9.6 | 16.0 | 14.5 |
| TNA (mg) | 0.81 | 1.34 | 1.26 |
| PUFF NUMBER | 8.2 | 13.8 | 9.3 |
| TOBACCO WEIGHT (mg) | 325 | 650 | 884 |

The table clearly indicates the effectiveness of the present invention in utilising tobacco at an increased level of efficiency.

What is claimed is:

1. A cigarette comprising a tobacco rod which rod comprises a tobacco filler and a paper wrapper, the circumference of said rod being within a range of 10 mm to 19 mm, and having a tobacco filler packing density within the range of 150 mg per $cm^3$ to 350 mg per $cm^3$ yielding a free burn rate of said rod within a range of 25 to 45 mg $min^{-1}$.

2. A cigarette as claimed in claim 1, wherein said circumference is within a range of 12.5 mm to 19 mm.

3. A cigarette as claimed in claim 1, wherein the packing density of said tobacco filler is within a range of 350 mg per $cm^3$ to 350 mg $cm^3$.

4. A cigarette as claimed in claim 3, wherein the packing density of said tobacco filler is within a range of 200 mg per $cm^3$ to 300 mg per $cm^3$.

5. A cigarette as claimed in claim 1 and further comprising a filter of the same transverse dimensions as said rod.

* * * * *